US005516072A

United States Patent [19]

Shinno

[11] Patent Number: 5,516,072

[45] Date of Patent: May 14, 1996

[54] ARTICLE MOUNTING DEVICE

[75] Inventor: Kunihiko Shinno, Okayama, Japan

[73] Assignee: Chugoku Art Materials, Inc., Okayama, Japan

[21] Appl. No.: 277,040

[22] Filed: Jul. 19, 1994

[30] Foreign Application Priority Data

Jul. 20, 1993 [JP] Japan ..... 5-039530

[51] Int. Cl.[6] ..... A47B 97/04

[52] U.S. Cl. ..... 248/460; 248/174

[58] Field of Search ..... 248/459, 460, 248/469, 473, 150, 152, 165, 174; 211/40, 41; 40/606, 610

[56] References Cited

U.S. PATENT DOCUMENTS

| | | | |
|---|---|---|---|
| 289,799 | 12/1883 | Barnes | 248/459 |
| 560,899 | 5/1896 | Frazee | 248/174 X |
| 806,716 | 12/1905 | Stevenson | 248/460 X |
| 1,485,786 | 3/1924 | Kraft | 248/460 |
| 2,648,931 | 8/1953 | Deveau | 248/460 |
| 3,282,437 | 11/1966 | Hansen | 248/460 X |
| 3,897,037 | 7/1975 | Johnson et al. | 248/460 |
| 4,871,139 | 10/1989 | Loewke et al. | 248/460 |
| 5,007,606 | 4/1991 | Allen et al. | 248/174 X |

FOREIGN PATENT DOCUMENTS

| | | | |
|---|---|---|---|
| 657337 | 3/1938 | Germany | 248/460 |
| 1921136 | 11/1970 | Germany | 248/460 |
| 87913 | 6/1956 | Norway | 248/460 |

*Primary Examiner*—Ramon O. Ramirez
*Assistant Examiner*—Derek J. Berger
*Attorney, Agent, or Firm*—Wenderoth, Lind & Ponack

[57] ABSTRACT

A small sized article mounting device for mounting an article or ornament such as a picture plate, a record jacket, a photograph, a book, a mirror, a painting, a ceramic plate and the like is constituted by a supporting member and a standing member each having a predetermined thickness. The supporting member has one end and the another end, and a plurality of grooves near to the other end. The standing member also has two ends. The length of the grooves is larger than the width of one end of the standing member and shorter than the width of the other end of the standing member. The width of each groove is nearly equal to the thickness of the standing member. The two members are assembled together by utilizing either one of the grooves, whereby the standing member is adapted to support the rear surface of the article, and the supporting member to support the lower portion of the article. The device is supported by one end of the supporting member and the other end of the standing member.

1 Claim, 4 Drawing Sheets

ARTICLE MOUNTING DEVICE

BACKGROUND OF THE INVENTION

1. Technical Field

This invention relates to an article mounting device for mounting thereon an article or an ornament such as a picture plate, a record jacket, a photograph, a book, a mirror, a painting, a ceramic plate and the like. Further, the device is of an assembly type and its size is relatively small.

2. Prior Art

FIG. 9 shows a prior art article mounting device 1 for mounting thereon an article or an ornament such as a picture plate and the like. The device 1 is constituted of a pair of generally L-shaped members 2 consisting respectively of horizontal portions 3 and vertical portions 4, with the rear surface portions of the vertical portions 4 being connected together by at least one hinge member (not shown in the drawing). In use, the L-shaped members 2 are opened to a predetermined angle, and the lower edge portions of the article are supported and retained by retaining portions 5 provided on the tip end portions of the horizontal portions 3 with the upper portions of the article being supported by the vertical portions 4, and the article is thereby stably supported on the device 1.

FIGS. 10 and 11 show two examples of small sized desk top type easels 6 and 12, respectively, of which the constructional type is well known and which are utilized similar to the device 1 of FIG. 9.

However, in the device 1 shown in FIG. 9, the location of the retaining portions 5 and of the highest portions of the vertical portions 4 are specified, and thus the inclination angle of the article or the ornament such as the picture plate and the like being mounted on the device 1 is fixed. Thus, when the size of the article is changed, the device 1 may fall down. It will be noted that the center of gravity and weight of the article have an important influence on stability.

Accordingly, an article or ornament such as a picture plate and the like have required a special mounting device.

Further, the L-shaped members 2 are connected by metal hinge members and the like, which may not be burnable and may impede the disposal of the device 1.

The small sized easels 6 and 12 shown in FIGS. 10 and 11 are undesirable since the number of constituent parts is great, and thus the assembling operations thereof are difficult.

Particularly, the small sized easel 6 shown in FIG. 10 comprises a long center column 7 for supporting an article or an ornament, a pair of frame members 8 supporting the center column 7 at opposite sides, a pair of legs 9 supporting respective frame members 8, and a pair of sturdy main frame members 10 supporting the lower ends of the frame members 8 and the legs 9. The assembling operation is very complicated and difficult, and to adjusting the inclination angle of the center column 7 and the frame members 8 and connect and tighten the constituent members at a predetermined location a large number of fitting parts such as screws and nuts are provided, and thus the device is heavy and expensive.

The small sized easel 12 shown in FIG. 11 is, as compared with the easel 6 of FIG. 11, advantageous in its reduced number of parts. However, the easel 12 comprises a center column 13, a pair of front legs 14 extending on opposite sides of the center column 13, a rear leg 15 extending in the rear central portion, and a pair of upper and lower cross bars 16 for connecting the center column 13 and the front legs 14, and means for adjusting the location of the rear leg 15 to adjust the inclination angle of the easel. Thus, the easel 12 is also heavy and expensive.

SUMMARY OF THE INVENTION

An object of the invention is to overcome the above described problem in the prior art device, and to provide an article mounting device not restricted the center of gravity or the size of the article.

A further object of the invention is to provide an article mounting device that is simple in construction, easy to assemble, light in weight, and cheap.

A still further object of the invention is to provide an article mounting device having various uses in mounting articles.

According to the invention, there is provided an article mounting device consisting of only two members that each have a predetermined thickness, namely, a supporting member and a standing member. The supporting member has two ends, with one end being provided with a plurality of inclination adjusting grooves, and the standing member has to ends. The length of the groove is larger than the width of one end of the standing member and smaller than the width of the other end of the standing member, and the thickness of the standing member is nearly equal to the width of the grooves. The device can thereby be easily assembled by inserting the standing member through one of the grooves in the supporting member, with the standing member being adapted to support the rear portion of the article and the supporting member being adapted to support the lower end portion of the article.

When the position of the center of gravity or the size of the article is changed, the inclination of the device (the standing member) can be easily changed by changing the position of the groove receiving therein the standing member.

BRIEF DESCRIPTION OF THE DRAWINGS

Further objects and advantages of the invention will become apparent from the following descriptions in conjunction with attached drawings, in which.

DETAILED DESCRIPTION OF THE PREFERRED EMBODIMENTS

Figure 1:
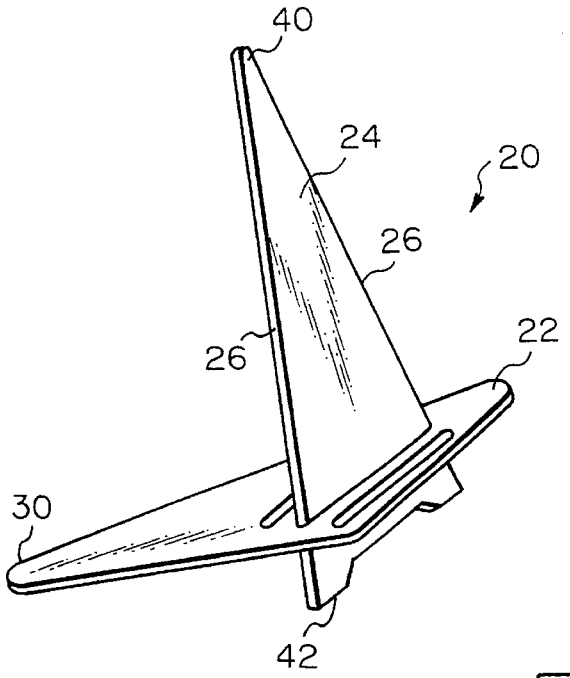
FIG. 1 is a perspective view of an article mounting device according to the invention.

FIG. 1 is a perspective view of an article mounting device 20 according to the present invention, and the device 20 is constituted of a supporting member 22 for supporting the lower portion of an ornament (not shown in the drawing) such as a picture plate or the like, and a standing member 24 for supporting the supporting member 22 at an inclined condition as shown in FIG. 1.

Figure 2:
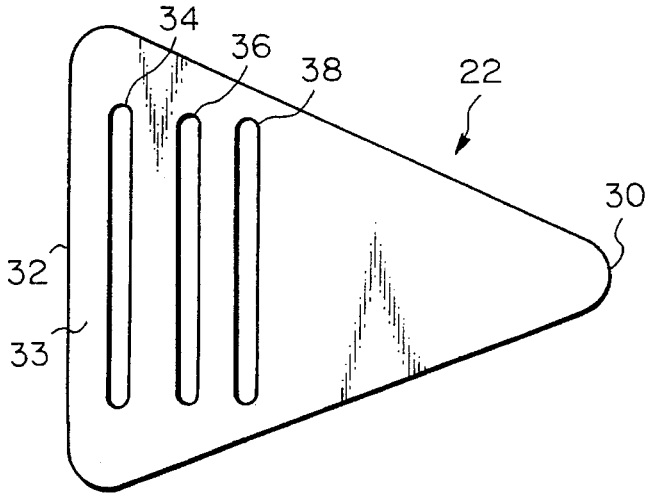
FIG. 2 is a plan view of a supporting member of the device of FIG. 1.

As shown in FIG. 2, the supporting member 22 is generally in the form of an isosceles triangle having one end 30 at an acute angle and the other end 32 defining the base of the triangle. There are provided three grooves 34, 36 and 38 extending generally parallel to the other end 32 and each having a predetermined width. In the embodiment, the groove 34 Is longer than the grooves 36 and 38 but, the grooves may be of equal length.

Figure 3:
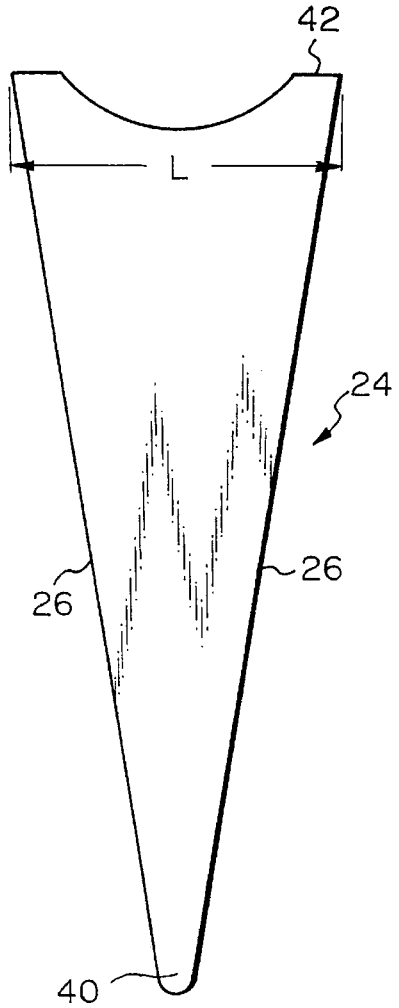
FIG. 3 is a plan view of a standing member of the device of FIG. 1.

As shown in FIG. 3, the standing member 24 is also generally in the form of an isosceles triangle shape having one end 40 at an acute angle, the other end 42 defining the base of the triangle, and edge portions 26 and 26 defining two sides of the triangle. The length of the sides 26 is longer than the two sides of the triangle of the supporting member 22.

Preferably, the members 22 and 24 are formed from a laminated wood having a thickness of about 6 mm. The width of the grooves 34, 36 and 38 is also about 6 mm, and the length thereof is larger than the width of the end 40 and smaller than the length L of the other end 42, whereby when the standing member 24 is inserted into one of the grooves 34, 36 and 38 in the supporting member 22, the two members 22 and 24 can be secured with each other.

Figure 4:
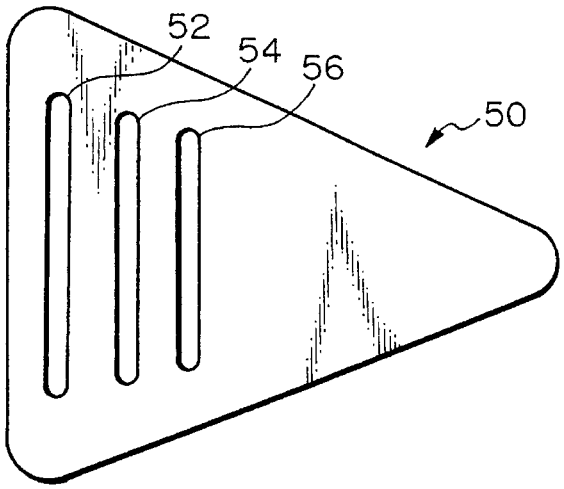
FIG. 4 is a plan view of another form of the standing member.

FIG. 4 shows a supporting member 50, which is slightly modified from the supporting member 22 shown in FIG. 2. The supporting member 50 differs from the member 22 in that the length of grooves 52, 54 and 56 formed in the member 50 are reduced sequentially as shown in the drawing.

Figure 5:
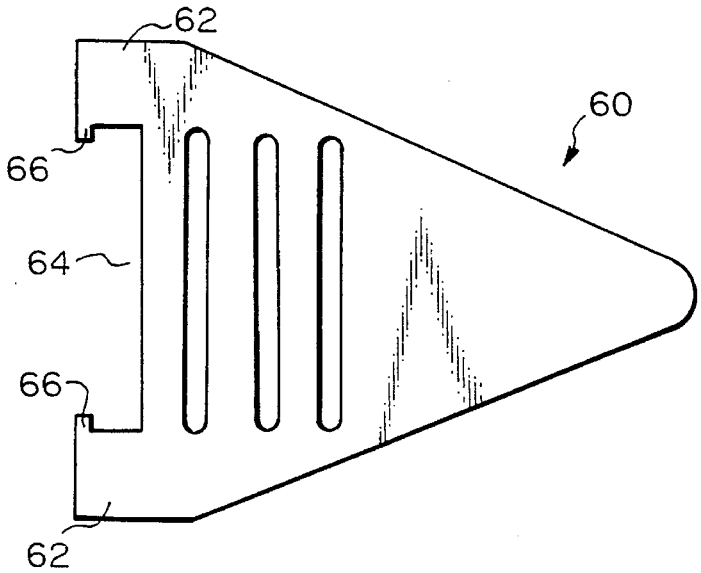
FIG. 5 is a plan view of further form of the standing member.

FIG. 5 shows a supporting member 60 which is further modified from the supporting member 22. The supporting member 60 differs from the member 22 in that a pair of projecting portions 62 are formed integrally on the bottom edge 32 of the supporting member 22, and a spaced portion 64 is defined between the projecting portions 62. There are formed small projections 66 on opposing outer edges of the projections 66 as shown in the drawing.

In assembling the article mounting device 20 of the invention, a supporting member 22 and a standing member 24 are selected at first in consideration of the size, the weight, the shape and the like of an article or ornament being mounted. Then the end 40, having an acute angle, of the standing member 24 is inserted into one of the grooves 34, 36 or 38 until the opposite sides 26 of the standing member 24 tightly contact with opposite ends of the groove 36 (as shown in FIG. 1). Then, the device 20 can be stably maintained by one end 30 of the supporting member 22 and the ends 42 of the standing member 24, with the end 30 and the ends 42 defining a triangle, as shown in FIG. 1.

In use, the lower end of an article or ornament is supported on the supporting member 22 at the position near to the other end 32, and the rear surface of the article is supported by the standing member 24. When the article is such as a picture plate and the like, the lower edge of the picture plate may be fitted in and supported by the groove 34, whereby a slipping of the picture plate can be reliably prevented.

For adjusting the angle of inclination of the device 20 or of the standing member 24, the groove in the supporting member 22 engaging with the standing member 24 is changed, such as from the groove 36 to the groove 38 to increase the angle, and from the groove 36 to the groove 34 to decrease the angle.

In the supporting member 50 shown in FIG. 4, the length of the grooves 52, 54 and 56 differs from each other. Thus when the groove receiving the standing member 24 is changed from the groove 54 to the groove 56, the angle of inclination of the standing member 24 can largely be changed.

The supporting member 60 shown in FIG. 5 is adapted to support a relatively large and heavy ornament. The lower portion of the ornament is received and supported in the spaced portion 64 which is defined by the pair of projecting portions 62, and the slipping of the ornament is prevented by the pair of projections 66 and 66.

In the embodiment shown in FIG. 2, the groove 34 provided adjacent to the other end 32 of the supporting member 22 is the groove for receiving and retaining the lower end portion of the ornament. However, the position and the shape of the ornament receiving and retaining portion may be changed as desired. For providing such an ornament receiving and retaining portion, it is preferable to increase the distance between the end 32 of the supporting member 22 and the nearest groove 34.

Further, in the embodiments, the supporting members 22, 50 and 60 and the standing member 24 generally are in the form of an isosceles triangle shape, but such a form is not limitative and, thus, the supporting member 22, 50 or 60 may be in any other form, such as a rectangle, a circle, an ellipse or the like. The standing member 24 is required to have an end 40 at an acute angle adapted to be received by either of the grooves 34, 36, 38 and the like in the supporting member 22 and the like, and is required to have the other end 42 of the length exceeding the length of the grooves. Further, the supporting member and the standing member are preferably formed of a laminated wood having the thickness of about 6 mm, however another material such as wood, transparent or colored synthetic resin plate and other materials may also be utilized.

Figure 6:
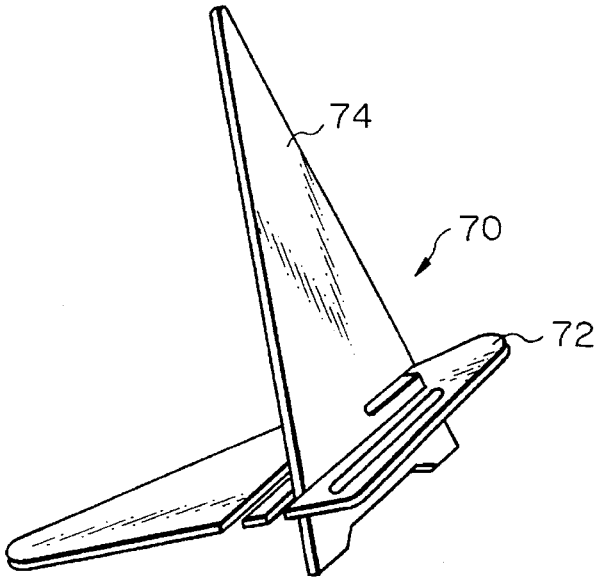
FIG. 6 is a perspective view of another form of the article mounting device according to the invention.
Figure 7:
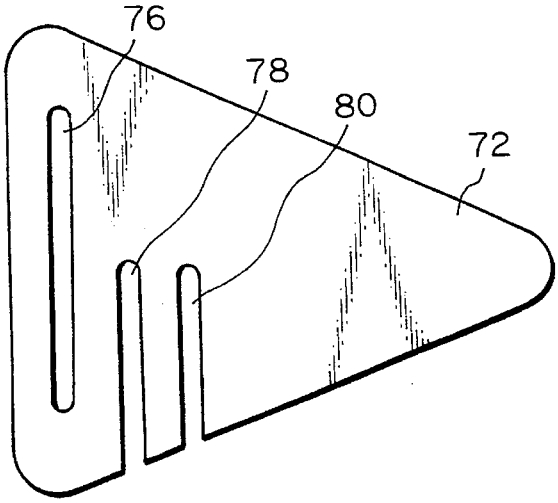
FIG. 7 is a plan view of a supporting member of the article mounting device of FIG. 6.
Figure 8:
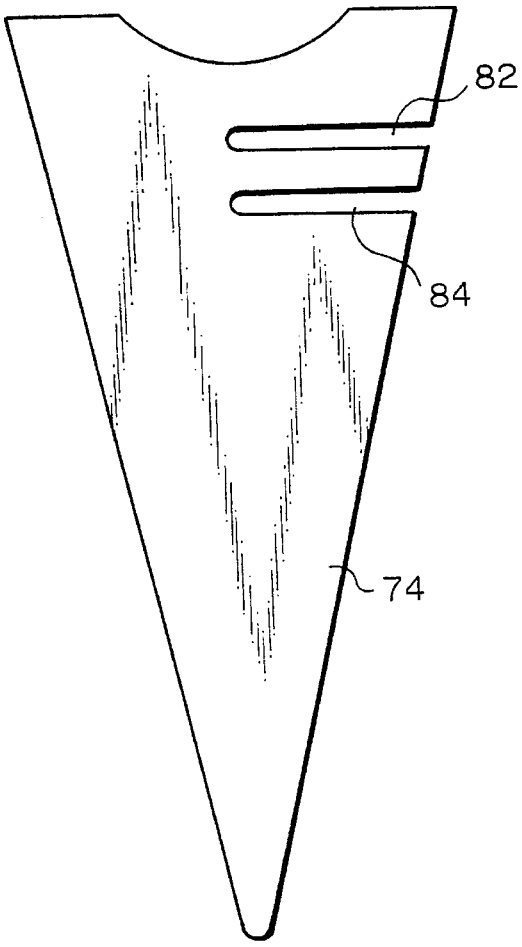
FIG. 8 is a plan view of a standing member of the article mounting device of FIG. 6.
Figure 9:
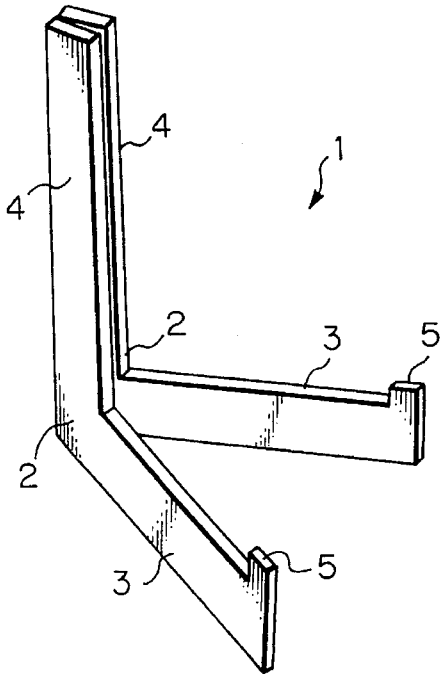
Fig. 9 PRIOR ART
FIG. 9 is a perspective view of a prior art article mounting device.
Figure 10:
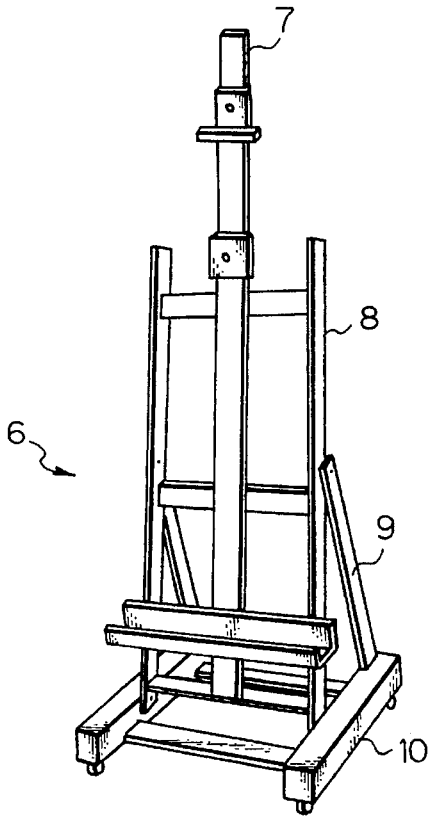
Fig. 10 PRIOR ART
FIG. 10 is a perspective view of another prior art article mounting device of the easel type.
Figure 11:
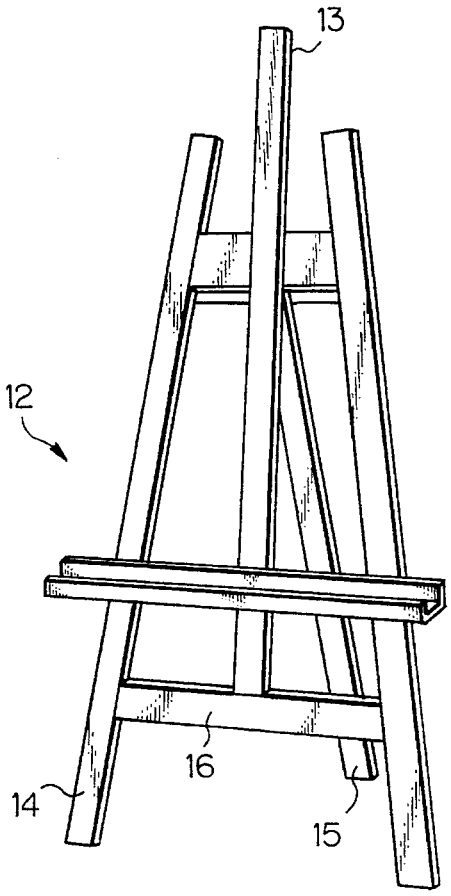
Fig. 11 PRIOR ART
FIG. 11 is a perspective view of a still further prior art article mounting device of the easel type.

FIGS. 6 through 8 show a further embodiment of the invention and correspond respectively to FIGS. 1 through 3 of the first embodiment. In the first embodiment, the grooves 34, 36 and 38 are formed in the supporting member 22, while in the embodiment of FIGS. 6 through 8 the grooves are formed in the standing member and in the supporting member. Particularly, the standing member 72 shown in FIG. 7 has grooves 76, 78 and 80, and the supporting member 74 shown in FIG. 8 has grooves 82 and 84.

In the embodiment, the standing member 72 and the supporting member 74 are assembled by assembling either one of grooves 78 and 80 in the supporting member 72 with either one of grooves 82 and 84 in the standing member 74. The groove 76 formed in the supporting member 72 is a groove for receiving and retaining the lower end portion of the ornament.

As described heretofore, the article mounting device according to the invention enables an article or ornament such as a picture plate, a record jacket, a photograph, a book, a mirror, a painting, a ceramic plate and the like to be mounted stably irrespective of the configuration and the center of gravity of the article, and the angle of inclination can be changed as desired. Thus, it is possible to omit troublesome and expensive work to prepare an article mounting device with exclusive usage in considering configuration, center of gravity and the like.

The article mounting device according to the invention is constituted by only two parts, the assembling operation is very easy, and the usage of particular fittings or connecting members is not required. Further, the parts can be easily manufactured, and thus the cost is very low.

What is claimed is:

1. An article mounting device, comprising:

a supporting member having a triangle shape with one end defining an acute angle, another end defining a base of the triangle shape of said supporting member and at least two grooves formed in said supporting member; and a standing member having a triangle shape with one end defining an acute angle and another end defining a base of the triangle shape of the standing member;

wherein said supporting member and said standing member each have a predetermined thickness, said at least two grooves of said supporting member have a width substantially equal to the predetermined thickness of said standing member and a length larger than the one end of said standing member and shorter than the other end of said standing member defining the base of the triangle shape of the standing member, and said at least two grooves in said supporting member comprise one groove closest to the one end of the triangle shape of said supporting member, the one groove being the shortest groove of said at least two grooves, and another groove closest to the other end of the triangle shape of said supporting member, the other groove being the longest groove of said at least two grooves.

* * * * *